US005660476A

United States Patent [19]

DeCoster

[11] Patent Number: 5,660,476

[45] Date of Patent: Aug. 26, 1997

[54] SHOPPING BAG

[75] Inventor: Pieter K. J. DeCoster, Aalst, Belgium

[73] Assignee: Dart Industries Inc., Orlando, Fla.

[21] Appl. No.: 653,188

[22] Filed: May 24, 1996

[51] Int. Cl.[6] ..... B65D 30/22; B65D 33/10

[52] U.S. Cl. ..... 383/29; 190/108; 383/37; 383/110

[58] Field of Search ..... 383/29, 37, 110; 190/108, 110; 150/111

[56] References Cited

U.S. PATENT DOCUMENTS

| | | | |
|---|---|---|---|
| 1,554,034 | 9/1925 | Richie . | |
| 1,751,902 | 3/1930 | Brown . | |
| 2,313,884 | 3/1943 | Mattoon . | |
| 4,424,841 | 1/1984 | Smith | 190/110 |
| 4,593,841 | 6/1986 | Lange . | |
| 4,756,394 | 7/1988 | Cohen | 190/110 |
| 4,887,837 | 12/1989 | Bonewicz, Jr. et al. . | |
| 5,005,679 | 4/1991 | Hjelle | 383/110 |
| 5,022,528 | 6/1991 | Savoy | 150/111 |
| 5,209,517 | 5/1993 | Shagoury . | |
| 5,219,423 | 6/1993 | Kamaya | 190/108 |
| 5,230,450 | 7/1993 | Mahvi et al. . | |
| 5,267,679 | 12/1993 | Kamaya et al. | 190/108 |
| 5,374,073 | 12/1994 | Hung-Hsin . | |
| 5,431,262 | 7/1995 | Rekuc et al. . | |
| 5,526,907 | 6/1996 | Trawick et al. | 383/110 |

*Primary Examiner*—Stephen P. Garbe
*Attorney, Agent, or Firm*—John A. Doninger

[57] ABSTRACT

A carrier pack including a shopping bag with a separate cooler bag strap-connected to and stacked with the shopping bag or, alternatively, received within the interior chamber of the shopping bag.

20 Claims, 4 Drawing Sheets

74
36
30
26
10
32
12
34
64
40
72
28
22
42
38
14
116

SHOPPING BAG

BACKGROUND OF THE INVENTION

Reusable shopping bags, particularly for groceries and the like, have become increasingly popular both as a matter of convenience, providing greater strength and handling capability, and, as a conservation means reducing the necessity for use of the conventional disposable paper and plastic shopping bags. The known reusable shopping bags are normally upwardly opening and include opposed loop handles for convenient carrying.

The use of shopping carts has also become increasingly popular, particular by the elderly, as a convenient means for handling the rather awkward conventional shopping bags. Such carts, much in the manner of a conventional hand cart or trolley, include a bottom support platform with a pair of wheels mounted on a single axle along one edge of the platform and a vertically extending combined backrest and handle for a tilting and rolling manipulation of the cart. As the cart is particularly adapted for supporting shopping bags, the cart will normally be provided with an upwardly opening basket as an extension of the platform and preferably fixed to the handle assembly for stability.

SUMMARY OF THE INVENTION

The carrier pack of the present invention, including a shopping bag with a cooperating cooler bag, is multifunctional and comprises a distinct improvement over the conventional reusable shopping bag.

More particularly, the shopping bag of the invention includes a versatile strap assembly to allow for a carrying of the bag as a hand bag, the carrying of the bag as a shoulder bag, and the mounting of the bag on a light weight luggage or hand cart with the cooler bag either externally strapped thereto or internally received therein.

The shopping bag includes a rectangular bottom wall, a rectangular rear wall secured to the rear edge of the bottom wall along the full length thereof, and opposed side walls secured to the opposed end edges of the bottom wall and to the opposed side edges of the rear wall. The side walls having forward edges which extend vertically from the bottom wall for approximately one half the height of the bag and then arc rearwardly to terminate at the upper edge of the rear wall.

The bag is closed by a front wall which is secured to the forward edge of the bottom wall and extends upwardly for the full height of the bag, following the contours of the opposed forward edges of the side walls and terminating at the upper edge of the rear wall. Releasable fastener means, preferably a zipper, extends along the full length of the side and top edges of the front wall with dual zipper glides which allow for an opening of substantially any portion of the front wall edges in a selective manner.

A flap-closed insulated pocket is provided within the chamber of the bag affixed to the inner face of the rear wall. A loop-defining strap is affixed to the inner face of one or both side walls for receiving and securely positioning bottles and the like. A pair of flap-closed storage pockets are provided on the outer face of the front panel extending upwardly from the bottom wall to a height approximately equal to the vertical portion of the front wall.

The cooler bag is an insulated rectangular container with access to the interior thereof provided by a side wall secured at one end thereof and zipper-closed about the remaining periphery. A "quick" closure flap is provided at the free end of the cooler pack side wall for allowing temporary closure of the cooler pack without a full closing of the peripheral zipper. A similar "quick" closure is provided on the upper edge of the front wall of the shopping bag.

Further details and features of the invention will become apparent from the more specific description of the invention following hereinafter.

BRIEF DESCRIPTIONS OF THE DRAWINGS

DESCRIPTION OF PREFERRED EMBODIMENT

Figure 1:
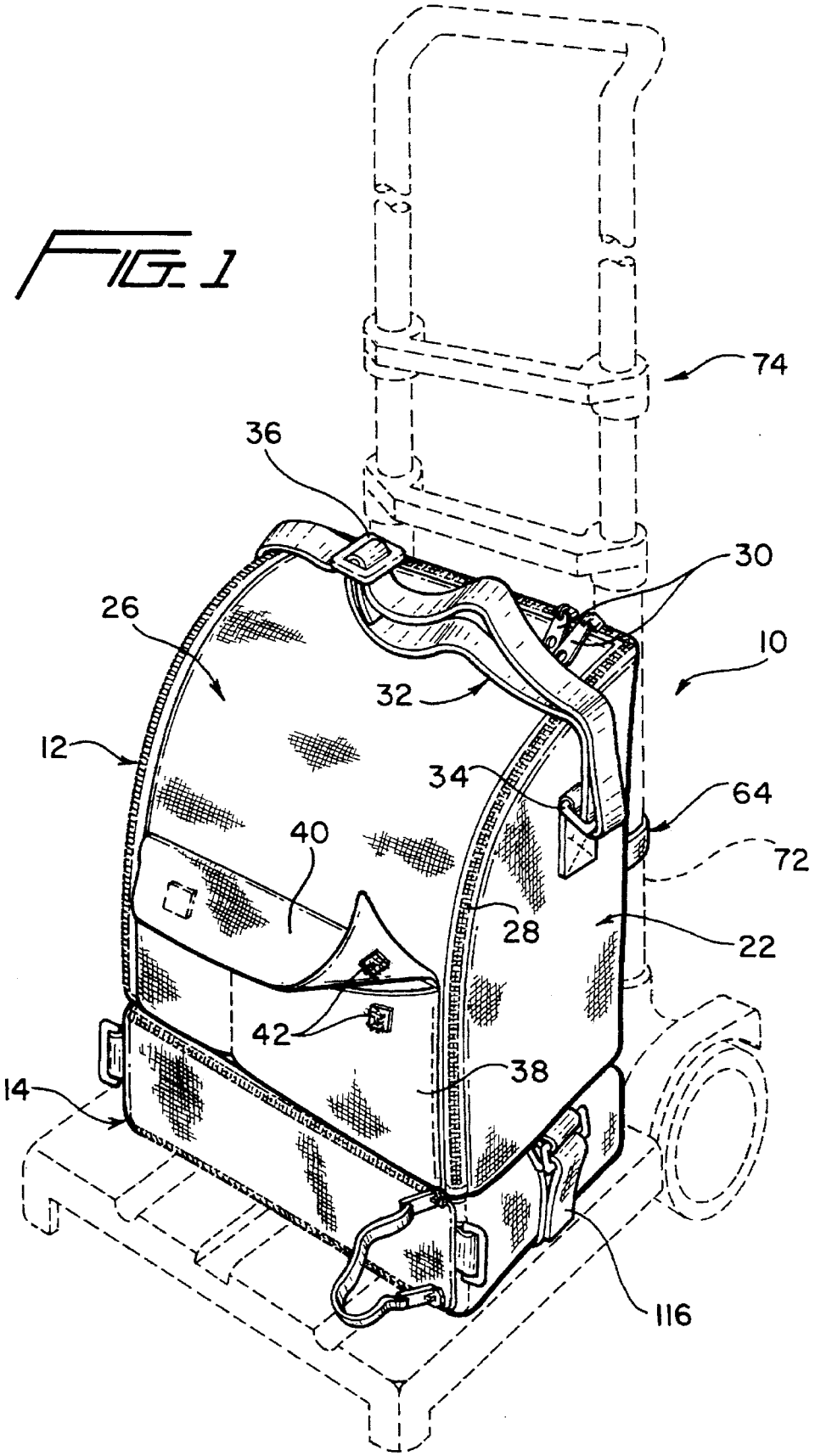
FIG. 1 is a perspective view of the stacked shopping bag and cooler pack mounted on the platform of a hand cart, the cart being shown in phantom lines.
Figure 2:
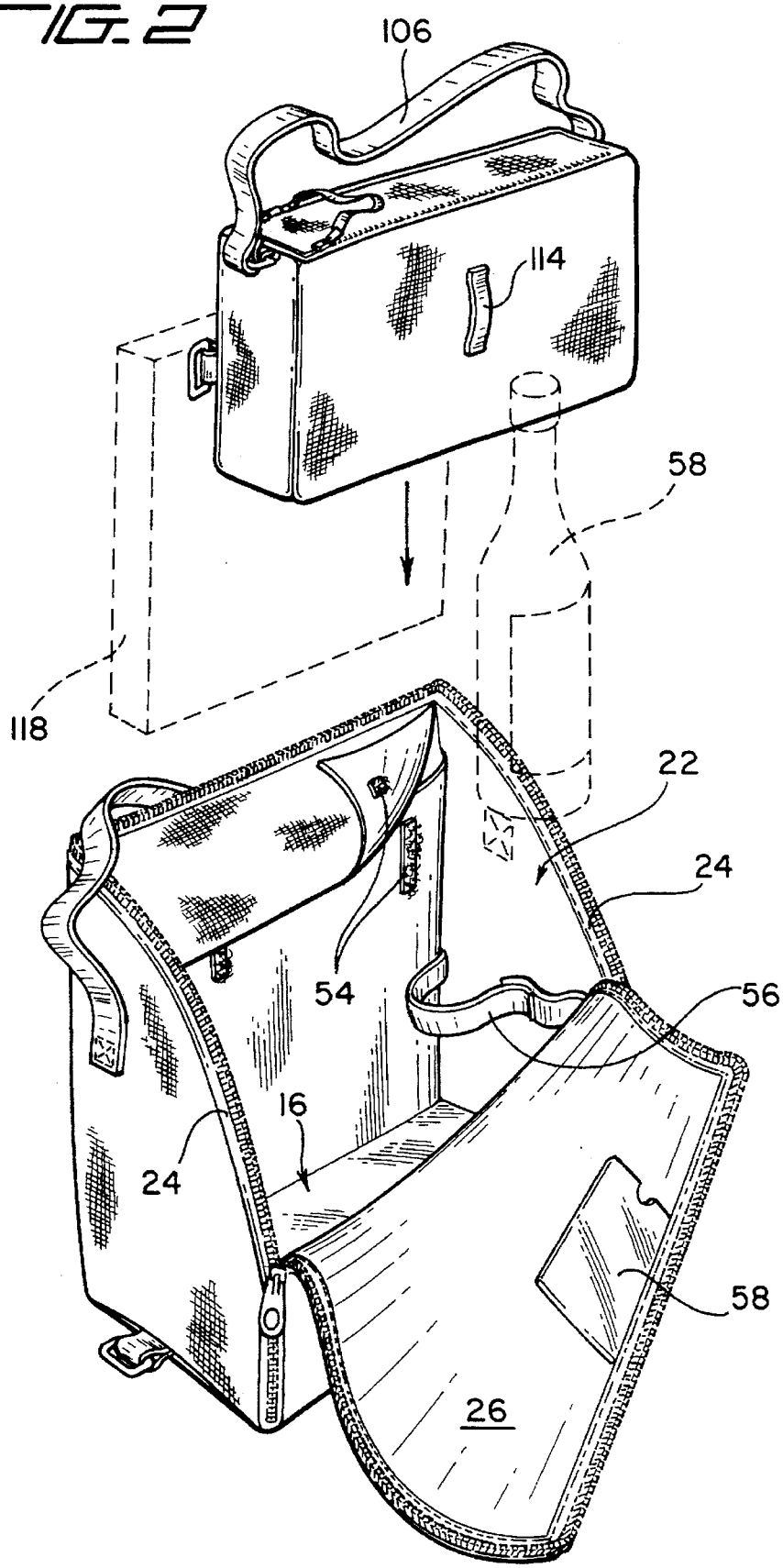
FIG. 2 is an exploded perspective view of the open shopping cart with the cooler pack aligned for introduction internally therein.

The carrier pack 10 of the invention basically comprises a shopping bag 12 and a cooler bag 14 separate from the shopping bag and selectively combined therewith in a stacked relationship as shown in FIG. 1 and in an internally stored position as suggested in FIG. 2. Both bags are formed of a strong flexible fabric, preferably of an appropriate synthetic resinous material such as nylon.

Figure 5:
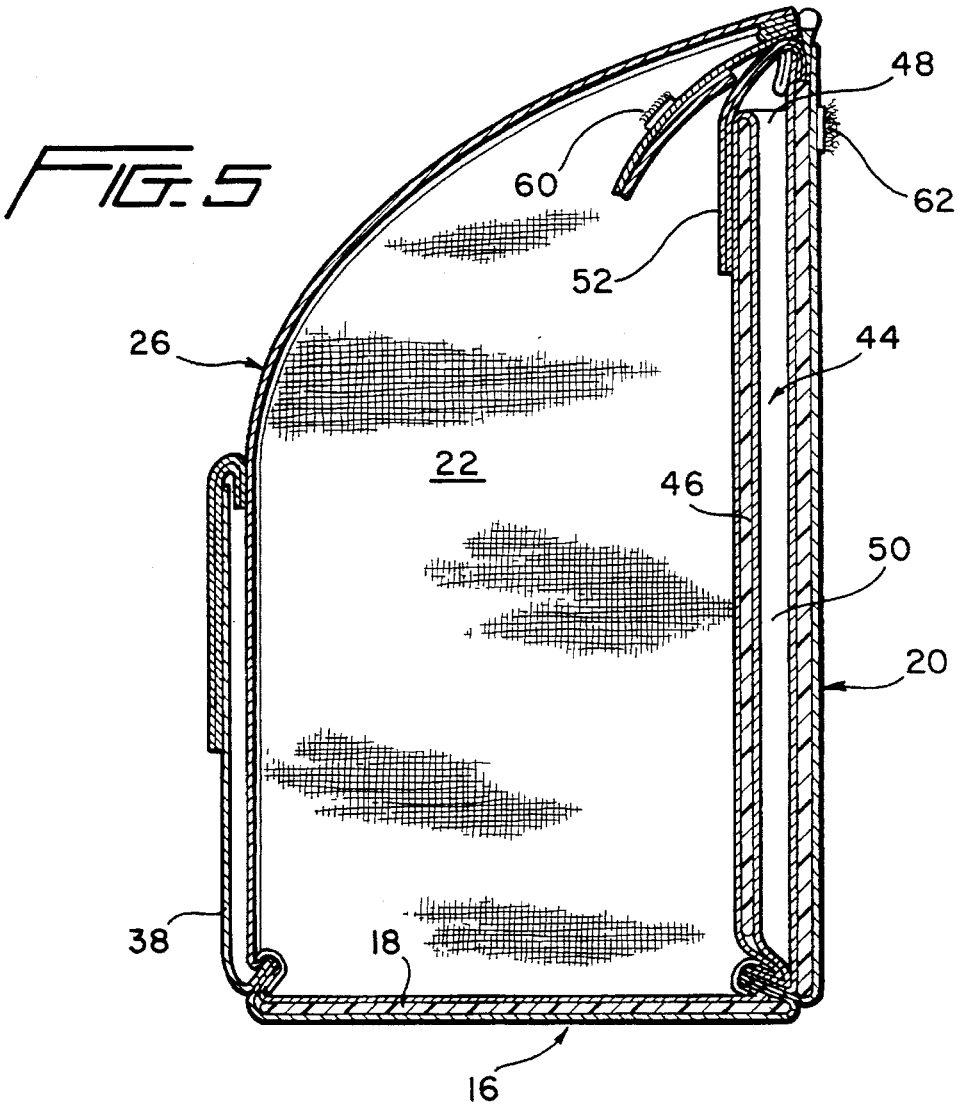
FIG. 5 is an enlarged vertical cross-sectional view through the shopping bag taken substantially on a plane passing along line 5—5 in FIG. 3.

Turning first to shopping bag 12, this bag includes a rectangular bottom 16 which, noting the cross-sectional view of FIG. 5, preferably includes a soft insulating panel 18 sandwiched between upper and lower fabric layers. A similarly insulated rectangular rear wall 20 is stitched or otherwise secured to and along the full length of the rear edge of the bottom 16 to extend vertically therefrom. Side walls 22, normally not insulated to facilitate a compact collapsing of the bag when empty, are each secured along the corresponding end edge of the bottom 18 and corresponding vertical edge of the rear wall 20 for the full extent thereof. Each of the side walls 22 includes a forward edge which, when the side walls 22 are fully extended, extends vertically from the bottom 16 for approximately one-half the height of the fully extended shopping bag 12. Above this vertical extent, the forward edges 24 arc rearwardly and terminate at the upper corners of the rear wall 20 at the juncture between the side walls 22 and the rear wall 20.

The exterior of the shopping bag 12 is completed by a front wall 26 which is joined, as by sewing, two and along the full length of the forward edge of the bottom 16. The front wall 26 is rectangular, normally uninsulated, and of a height to follow the contours of the opposed forward edges 24 of the side walls 22.

It is intended that the front wall 26 open completely to expose the internal chamber of the shopping bag 12. Accordingly, the opposed side edges of the front wall 26 and the top edge thereof are adapted, when the front wall 26 is closed, to lie closely adjacent the forward edges 24 of the side walls 22 and along the top edge of the rear wall 20 with a continuous zipper or slide fastener 28 extending along these adjacent edges and selectively opened and closed by a pair of glides 30 which function as a convenient means to allow for a partial or selective opening of the front wall 26, as well as a rapid full opening thereof with the front wall 26 retained only by the secured lower edge thereof. Such an arrangement is particularly desirable in emptying the chamber and for allowing complete access to the chamber for cleaning purposes. The front wall 26 is the fully erected bag as illustrated FIGS. 1 and 5, provides, in a single panel, both the front and top of the shopping bag 12. The front wall 26 extends vertically from the bottom 16 for approximately one-half the height of the bag, and then arcs rearwardly to terminate in the upper edge of the rear wall 20. So configured, the shopping bag 10 can be conveniently carried under one's arm, nesting comfortably within the normal arc of the arm below the shoulder. Carrying of the bag in this manner will be greatly facilitated by an elongate adjustable should strap 32 sewn to the exterior of one side wall 22 and releasably engaged through a loop 34 fixed to the opposite side wall 22. As will be appreciated, the strap 32 can also be used as a handle upon a shortening thereof through the adjustable buckle 36 thereon.

The front wall 26 has two large pockets 38 sewn or otherwise secured on the forward face thereof and extending upward from the lower edge to a height substantially equal to the vertical extent of the expanded bag. A single full length flap 40 is used to close the open upper ends of the bags 38 as protection against rain, to secure the contents thereof, and the like. The flap 40 will preferably be secured in its closed position by quick-release fasteners such as fabric hook and loop fasteners 42, for example Velcro®.

The interior chamber of the shopping bag 12 includes a substantially full height cooler pocket 44 immediately inward of the rear wall 20 and defined by the rear wall 20 and a forward insulated panel 46 substantially coextensive with the rear wall 20 and secured thereto along the side and bottom edges to define an upwardly opening mouth 48. The pocket 44 includes a degree of expandability by the utilization of thin side gussets 50 which actually secure the side edges of the panel 46 to the side edge portions of the rear wall 20. The pocket 44 is closed by an overlying full length flap 52 having the upper edge thereof joined to the upper edge of the rear wall 20 and extending downward over the forward face of the front panel 46 to which it is releasably secured by appropriate fabric hook and loop fasteners 54 which, as illustrated in FIG. 2, may be vertically elongate to accommodate expansion of the pocket 44.

The shopping bag chamber is also provided with a bottle-securing strap 56 transversely across the interface of one or both of the side walls 22 and functioning as to retain a bottle 58 vertically within the chamber and against the corresponding side walls 22. The strap 56 has the opposed ends thereof secured at the forward and rear edges of the corresponding side wall 22 and, for a snug engagement with a received bottle, can be adjustable. As an example, the strap 56 can be formed of two separate lengths with the free end portions thereof adjustably joined by hook and loop fasteners.

While it is desirable to keep the shopping bag chamber closed during shopping, it is similarly desirable to avoid the necessity of constantly zipper closing and opening the bag. Accordingly, a quick closure flap 58 is stitched or otherwise secured to the upper edge portion of the front wall 26 inward of the zipper and so as to lie against the inner face of the wall 26. The under surface of the flap 58 is provided with one element 60 of a hook and loop fastener, the other element 62 of which is mounted on the rear face of the rear panel 20 toward the upper end thereof. Thus, as a temporary closure means for the front access wall 26, the flap 58 is swung outwardly beyond the upper edge of the front wall 26 to overly the rear face of the rear wall 20 whereat the hook and loop elements 60 and 62 releasably interlock and thus hold the front wall 26 closed. The flap 58 in its locked position will be best seen in FIG. 3, and in its stored position in FIGS. 2 and 5. The flap 58 actually forms a dual function in that the flap is in the nature of a side opening transparent pocket which is particularly adapted to receive a shopping list for a display thereof when in its locking position as in FIG. 3. The pocket received shopping list will be easily viewed with the shopping bag mounted to a hand cart, and also as the flap is selectively secured and released.

With continued reference to FIG. 3, it will be noted that the rear wall 20 includes upper and lower transverse mounting straps 64, each of which includes a first end 66 secured, as by stitching, to the rear wall 20 from which the strap 64 extends through a laterally spaced wall mounted loop 68 and is subsequently folded back upon itself and secured by a elongate hook and loop fastener 70. These straps 64 are particularly useful in releasably securing the shopping bag 12 to the uprights 72 of a hand cart 74. The shopping bag 12 is completed by a pair of outwardly projecting loops or metal buckles, one affixed to each side thereof by short stub straps 78 sewn or otherwise secured within the seam between the lower edge of the corresponding side wall 22 and the corresponding side edge of the bottom 16.

The cooler bag 14 includes a pair of laterally spaced face panels 80 and 82, each being rectangular and of substantially the same size as the bottom 16 of the shopping bag 12. The face panels 80 and 82 are edge joined, as by stitching or the like, to opposed end panels 84 and a bottom or rear panel 86. The panels 80–86 form soft flexible walls with insulating layers between inner and outer fabric layers to provide an insulated compartment for frozen foods and the like.

The fourth of the peripheral panels, the top or front panel 88 was permanently secured at only one end 90 thereof to the adjoining end of the corresponding end panel 84. This front panel 88 is in the nature of a closure, allowing selective access to the internal compartment of the cooler bag. For a temporary and easily opened closing of the front panel 88, the free end portion thereof is provided with one element 92 of a hook and loop fastener, the other element 94 of which is affixed to the upper face of a short flap 96 secured to the upper end of the second end panel 84. So affixed, the front access panel 88 can be readily opened and closed as required during shopping and the like.

For a more secure closing of the panel 88, zipper-type fastener means are provided along the opposed longitudinal edges of the panel 88 and the corresponding top or front edges of the face panels 80 and 82. Each of the zippers 98 is provided with a separate zipper glide 100 with, for ease of manipulation, both glides 100 being interconnected by a handle strap 102. The strap 102 allows for a smooth and quick manipulation of both zippers when either opening or closing the zippers. This front panel 88 is also insulated by the incorporation therein of an intermediate insulating layer or layer of insulating material.

Figure 6:
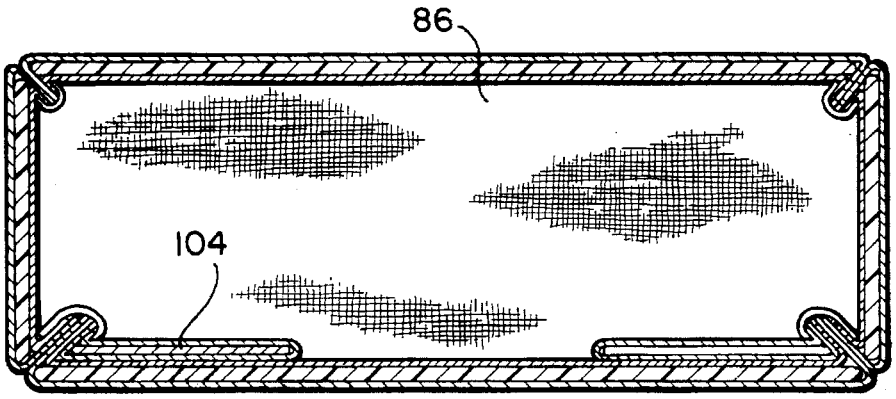
FIG. 6 is an enlarged cross-sectional view taken substantially on plane passing along line 6—6 in FIG. 4.

In order to enhance the stability of the cooler bag 14, particularly when used in the manner illustrated in FIG. 1, the bottom and top or rear and front panels 86 and 88 may be relatively rigid. The end panels 84 can in turn be selectively rigidified by internal rigidifying flaps 104 which are sewn or are secured along one edge thereof at the juncture between the face panel 80 and each end panel 84 for selective movement between a collapsed position overlying the inner surface of the face panel 80 and a compartment stabilizing position lying against the inner surfaces of the opposed end panels 84, note FIG. 6.

Figure 4:
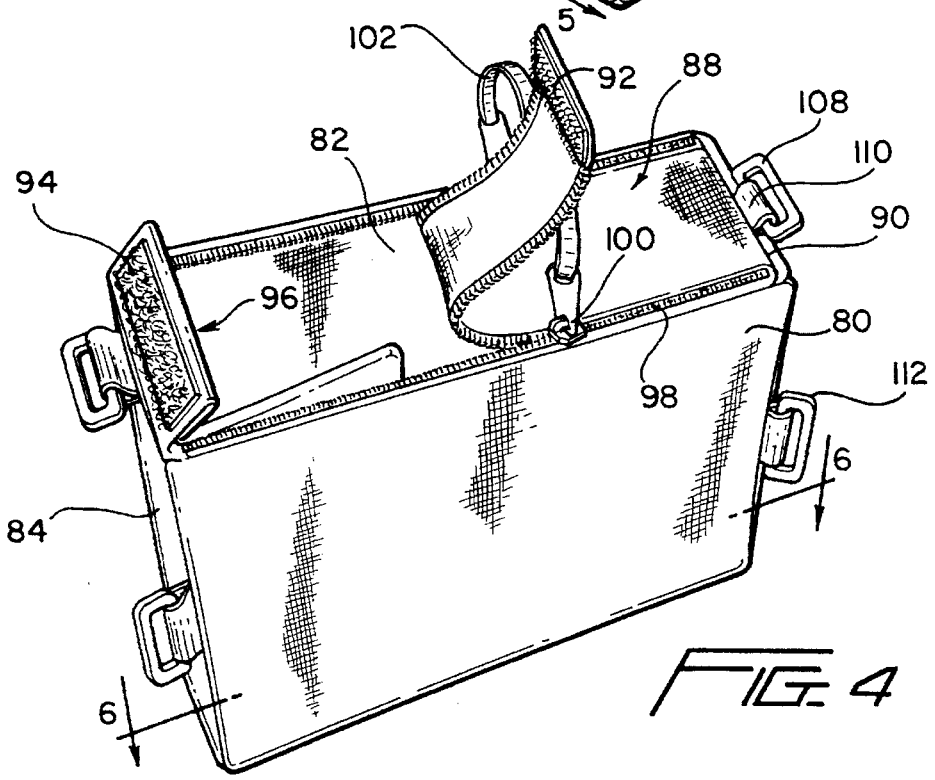
FIG. 4 is a perspective view of the cooler pack with the access portion of the peripheral wall partially open.

Note in FIGS. 2 and 4, in order to accommodate a separate shoulder or carrying strap 106 for the cooler bag 12, the opposed end panels, at the ends thereof corresponding to the access panel 88, have a pair of projecting loops 108 fixed thereto by stub straps 110 sewn or otherwise secured thereto. The carrying strap 106 will preferably be entirely removable with the free ends thereof engaged with an appropriate buckle or, alternatively, incorporating hook and loop fasteners.

Similar strap-mounting loops 112 are mounted to the opposed edges of the face panel 80, at the juncture with the end panels 84 and correspond in placement with the loops 76 at the bottom portion of the shopping bag 12. A stabilizing loop-forming strap 114 is also sewn or otherwise affixed to the opposed face panel 82 centrally thereof and in alignment with the loops 112.

Noting FIG. 1 in particular, the two bags have been assembled with the shopping bag 12 stacked on and secured to the cooler bag 14. The cooler bag 14 is oriented with the top or access panel 88 forwardly directed for easy access thereto. As will be appreciated in this position, the internal rigidifying panels 104 lie adjacent the cooler bag side panels 84 and in effect provide direct support for the overlying shopping bag 12.

The two bags, thus assembled, are retained together by a strap 116, which may either be a separate strap or the strap forming the handle 106 for the cooler bag 14. This strap 116 extends through the downwardly facing strap loop 114 on the lower face panel 82 of the cooler bag and upwardly along the opposed side panels 84 through the aligned and adjacent loops 112 and 76 respectively on the cooler bag 14 and overlying shopping bag 12. The strap 116 can have the opposed ends thereof secured in any appropriate manner, either by buckles or, preferably, hook and loop fasteners of the type, for example, shown on the straps 64 in FIG. 3.

The bags, assembled in this manner, can be supported on a hand cart 74 as suggested in FIG. 1, this being particular convenient while shopping. Similarly, in light of the positive joinder of the bags together, the assembly can easily be carried beneath one arm with the shopping bag strap 32 acting as a shoulder strap.

Figure 3:
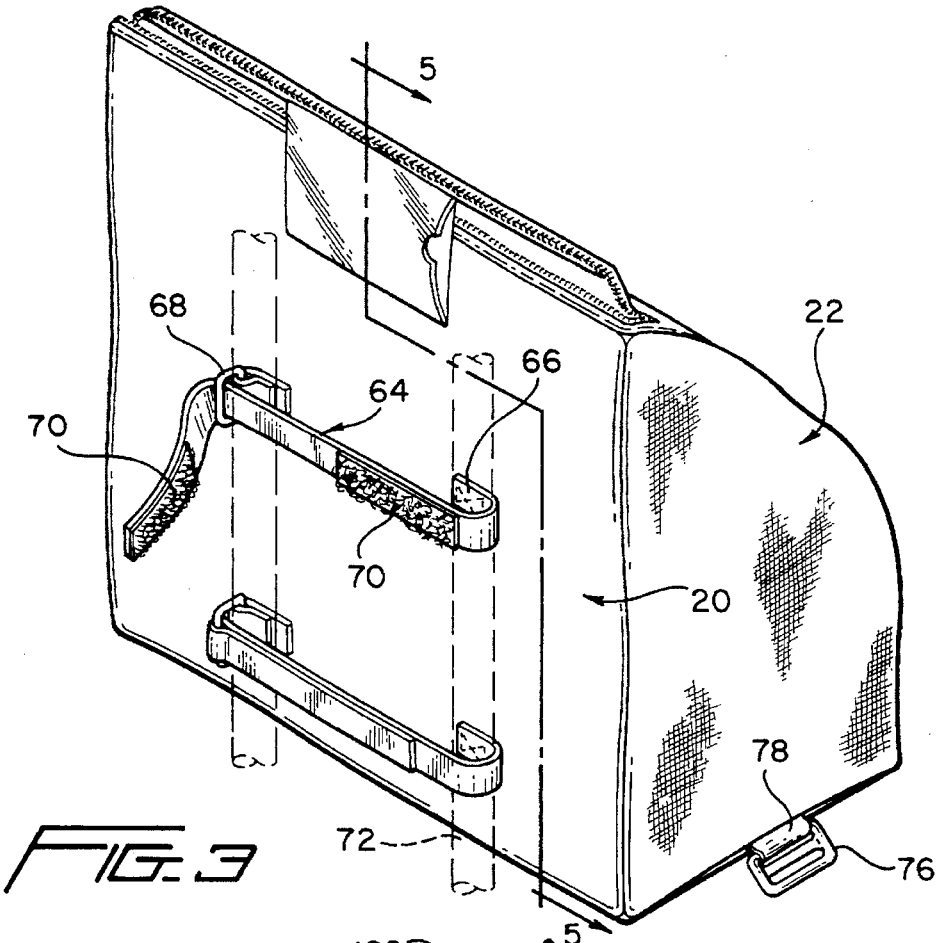
FIG. 3 is a rear perspective view of the shopping cart with the rear straps positioned for securement of the bag to the upright of a hand cart.

When mounted to a shopping cart 74, and noting FIG. 3, the rear straps 64 on the shopping bag will conveniently loop about the uprights 72 of the cart 74 while the lower end of the assembly, that is the bottom face of the cooler bag, rests on the cart platform. FIG. 3 also illustrates the securing flap 58 releasably engaged with the rear wall 20, thus providing a convenient temporary closure for the front wall 26 of the shopping bag and at the same time clearly exposing the shopping list or the like removably received within the flap 58.

Noting FIG. 2, the chamber of the shopping bag 12, immediately forward of the rear pocket 44, is of a predetermined height sufficient so as to receive the vertically positioned cooler bag 14 therein. The cooler bag 14 will actually be positioned slightly forward in those instances wherein the cooling pocket 44 is expanded to accommodate frozen pizza or light relatively narrow frozen food boxed 118 as also suggested in FIG. 2. While it is appreciated that the cooler bag 14 is of approximately equal length with the shopping bag 12 as indicated in the stacked relationship of FIG. 1, the flexible side walls 22 of the shopping bag 12 are capable of upstanding slightly to receive the cooler bag 14 within the shopping bag chamber.

The bags, assembled in the manner suggested in FIG. 2, provide a compact conveniently carried assembly with direct vertical access for the introduction and removal of foodstuff into the cooler pocket 44, cooler bag 14 and at least the forward portion of the shopping bag internal chamber, as well as the external pockets 38 on the front wall 26 of the shopping bag 12.

The carrier pack, as thus described, is a unique assembly of two uniquely formed bags, a shopping bag and a cooler bag selectively stacked with the shopping bag or compactly received therein. The shopping bag has an opening front wall providing access to the storage chamber therein. The front wall, when closed, defines an upper arcuate configuration for a convenience nesting of the shopping bag beneath one's arm when the assembly is carried by a shoulder strap. The cooler bag has the full length top panel or wall thereof releasably closed to define an access opening exposing the entire internal compartment to allow for the introduction of frozen food packages and the like. The entire carrier pack, through a selective combining of the two basic bag thereof, adapts for convenient mounting on a shopping cart, a shoulder carrying of the two bags and an individual carrying of each bag, all depending upon the particular use to which the carrier pack is being put.

The foregoing is considered illustrative of the principals of the invention. While a single embodiment of the carrier pack has been illustrated and described, it is to be appreciated that the illustrated embodiment is not to be considered a limitation on the invention or the scope of protection herein sought. Rather, the invention is to only be limited by the scope of the claims following hereinafter.

I claim:

1. A carrier pack comprising a shopping bag with a cooler bag removably associated therewith, said shopping bag including a bottom with a peripheral edge, walls fixed to said bottom and extending upward from said bottom to define a storage chamber, said chamber having a rear portion of a predetermined height, said cooler bag comprising opposed spaced facing panels with peripheral wall panels extending between said face panels thereabout to define an internal compartment, one of said peripheral panels forming an access panel releasably secured for selective opening to provide access to said internal compartment, said cooler bag selectively underlying said shopping bag with one of said cooler bag facing panels received against said shopping bag bottom and having a peripheral edge substantially coextensive with the peripheral edge of said bottom, releasable securing means on said shopping bag and said cooler bag releasably securing said cooler bag to and beneath said shopping bag; said cooler bag, when positioned with said access opening upward, being of a height less than said predetermined height of said rear portion of said chamber for selective reception of said cooler bag within said chamber.

2. The carrier pack of claim 1 wherein said cooler bag is rectangular.

3. The carrier pack of claim 2 wherein said releasable securing means on said shopping bag and said cooler bag comprise a strap encircling said cooler bag and strap-receiving loop members both on said shopping bag adjacent said bottom and on said cooler bag, said loop members being provided in two pairs of members, one member on said shopping bag and one on said cooler bag, said pairs of members receiving opposed ends of said strap.

4. The carrier pack of claim 3 wherein said access panel has a first fixed end, a remote second end and opposed sides, slide fastening means releasably securing said access panel sides to said face panels along adjacent edges, and quick release fastening means releasably securing said second end of said access panel to an adjacent cooler bag wall panel independently of said slide fastening means.

5. The carrier pack of claim 4 including a pair of handle mounting members fixed to said cooler bag, one adjacent each end of said access panel, and a handle strap selectively engaged with said handle mounting members.

6. The carrier pack of claim 5 wherein said shopping bag walls include a rear wall, opposed side walls and a front wall, said front wall having a lower edge secured along a portion of the peripheral edge of said bottom, opposed side edges releasably secured to said side walls and a top edge releasably secured to said rear wall, slide fastening means extending along said side edges and top edge of said front wall for releasably securing said edges and allowing for an opening of said front wall for access to the storage chamber.

7. The carrier pack of claim 6 wherein said shopping bag front wall includes a lower portion adapted to extend vertically from said bottom, and an upper portion arcing rearward from said vertical lower portion to engagement with said rear wall.

8. The carrier pack of claim 7 including a quick release flap fastener affixed to said shopping bag front wall adjacent the upper edge thereof, said flap fastener selectively positioned to overly said rear wall, and releasable fastening means on said flap fastener and rear wall for selectively securing said flap fastener with said front wall closed and the upper edge of said front wall adjacent said rear wall.

9. The carrier pack of claim 8 wherein said flap fastener comprises a transparent pocket for selective reception of informational material.

10. The carrier pack of claim 9 wherein said front wall has a pocket on said lower vertical portion thereof, said pocket being upwardly opening, and closing means for selective engagement over said pocket.

11. The carrier pack of claim 10 including an insulated cooler pocket within said shopping bag chamber immediately forward of said rear wall, said cooler pocket opening upward, and a closure flap selectively engageable over said upwardly opening cooler pocket.

12. The carrier pack of claim 11 wherein said rear wall of said wall of said shopping bag has a rear exterior face, and a strap on said exterior face for mounting said shopping bag to an exterior support.

13. The carrier pack of claim 12 including a shoulder strap for said shopping bag having opposed end portions secured to opposed said side walls of said shopping bag in vertically spaced relation above said shopping bag bottom.

14. The carrier pack of claim 4 wherein said slide fastening means includes a pair of slide fasteners, one along each of said access panel sides, and a single handle having opposed end portions respectively engaged with said two slide fasteners for simultaneous operation of said two slide fasteners in opening and closing said access panel.

15. The carrier pack of claim 1 wherein said shopping bag walls include a rear wall, opposed side walls and a front wall, said front wall having a lower edge secured along a portion of the peripheral edge of said bottom, opposed side edges releasably secured to said side walls and a top edge releasably secured to said rear wall, slide fastening means extending along said side edges and top edge of said front wall for releasably securing said edges and allowing for an opening of said front wall for access to the storage chamber.

16. The carrier pack of claim 15 wherein said shopping bag front wall includes a lower portion adapted to extend vertically from said bottom, and an upper portion arcing rearward from said vertical lower portion to engagement with said rear wall.

17. The carrier pack of claim 16 including a quick release flap fastener affixed to said shopping bag front wall adjacent the upper edge thereof, said flap fastener selectively positioned to overly said rear wall, and releasable fastening means on said flap fastener and rear wall for selectively securing said flap fastener with said front wall closed and the upper edge of said front wall adjacent said rear wall.

18. The carrier pack of claim 17 wherein said flap fastener comprises a transparent pocket for selective reception of informational material.

19. A carrier pack of claim 15 wherein said rear wall of said wall of said shopping bag has a rear exterior face, and a strap on said exterior face for mounting said shopping bag to an exterior support.

20. The carrier pack of claim 19 wherein said front wall includes a pocket on the vertical lower portion thereof, said pocket being exterior of said front wall and opening upward, and an internal pocket within said shopping bag chamber formed immediately forward of said rear wall and including insulating panels and a closure flap.

* * * * *